US005172968A

United States Patent [19]

Robinson

[11] Patent Number: 5,172,968

[45] Date of Patent: Dec. 22, 1992

[54] SECURITY CASING

[75] Inventor: Nigel Robinson, Barnsley, England

[73] Assignee: Shutters of Substance Limited, Barnsley, England

[21] Appl. No.: 693,312

[22] Filed: Apr. 29, 1991

[51] Int. Cl.[5] ..... A47B 88/00

[52] U.S. Cl. ..... 312/297

[58] Field of Search ..... 312/297, 257.1, 265.2, 312/223; 109/24, 495

[56] References Cited

U.S. PATENT DOCUMENTS

| | | | |
|---|---|---|---|
| 1,877,470 | 9/1932 | Mastrangelo et al. | 312/297 X |
| 2,341,914 | 2/1944 | Fleischman | 312/297 |
| 2,722,469 | 11/1955 | Kosovsky | 312/297 X |
| 3,297,377 | 1/1967 | Smith | 312/297 X |
| 4,470,457 | 4/1984 | Fogelman et al. | 312/7.2 |

*Primary Examiner*—Joseph Falk

*Attorney, Agent, or Firm*—Trexler, Bushnell, Giangiorgi & Blackstone

[57] ABSTRACT

A security casing (1) for protecting a bandit type gaming machine (2) from cash theft, comprises a sheet steel carcase made up of two side panels (3) reflecting the profile of conventional side panels of a bandit type gaming machine, a base panel (4), a back panel (5) and a top panel (6), all being rectangular and approximating in dimensions to the base, back, and top dimensions of a bandit type gaming machine, so that the casing (1) as a whole is a reasonably close fit about an industry-standard bandit-type gaming machine, the panels (3, 4, 5 and 6) being secured together to define an open fronted casing, a lower door (21) releasably attached to, and extending upwardly from, the base panel (4) and extending laterally to the side panels (3) to which it is also releasably attached, a metal-lath shutter (12) located within the casing (1), at a front zone of the casing, and being movable between a retracted position in which the casing is open to provide access to the gaming machine and a deployed position, in which the casing and hence the gaming machine are closed-off, the deployed shutter defining a front of the casing, with ends of the laths (14) of the shutter (12) being displaceable along guide tracks (7) provided along front edges of the side panels (3), with means (15, 16, 17) to lock the shutter (12) in its deployed position.

20 Claims, 6 Drawing Sheets

SECURITY CASING

This invention relates to a security casing, for the housing of a gaming machine of the so-called "bandit" type.

With the increasing level of pay-out of such machines, it is necessary for each machine to contain ever increasing amounts of cash, which as a cash container presents an attractive target for thieves and a security hazard for owners, operators of such machines particularly where multiple machines are unattended overnight in premises such as clubs, etc, as well as presenting insurers with losses. Whilst it might be thought that the provision of an armoured carcase on the gaming machine would present a solution, this leads to excessive weight and hence handling problems, particularly as there is usually a rapid turnover of machines e.g. every 9–12 months, with the machines returned to a manufacturer, for machines carcase to be refurbished and fitted with up-dated internal components, and consequently the thousands of existing carcases represent a considerable investment which cannot be scrapped but must continue in service for their design life.

According to the present invention there is provided a security casing for protecting a bandit type gaming machine from cash theft, the casing comprising a sheet steel carcase made up of two side panels reflecting the profile of conventional side panels of a bandit type gaming machine, a base panel, a back panel and a top panel, all being rectangular and approximating in dimensions to the base, back, and top dimensions of a bandit type gaming machine, so that the casing as a whole is a reasonably close fit about an industry-standard bandit-type gaming machine, the panels being secured together to define an open fronted casing, a lower door releasably attached to, and extending upwardly from, the base panel and extending laterally to the side panels to which it is also releasably attached, a metal-lath shutter located within the casing, at a front zone of the casing, and being movable between a retracted position in which the casing is open to provide access to the gaming machine and a deployed position, in which the casing and hence the gaming machine are closed-off, the deployed shutter defining a front of the casing, with ends of the laths of the shutter being displaceable along guide tracks provided along front edges of the side panels, with means to lock the shutter in its deployed position.

It follows, that when the club etc, premises are closed at the end of business, the shutter of each casing is deployed to the closed-off position and locked overnight and the casing in accordance with the invention provides a close fitting, protective metal sheath. Clearly, the thickness and quality of the sheet steel should be such that it is satisfactorily resistant to reasonable efforts of penetration and/or deformation, whilst not being of inordinate weight, whilst the casing lends itself to being retro-fitted to already-installed, bandit-type gaming machines.

The shutter is preferably a roller shutter, in contrast to a slide shutter. Although the roller shutter could be operable about a vertical axis, by rotatably supported at one lateral side of the casing and displaceable horizontally between retracted and deployed positions, the roller shutter is preferably operable about a horizontal axis and is thus displaceable vertically. In this last mentioned arrangement, although the roller shutter could be located at a lower portion of the casing i.e. at floor level, the roller shutter is preferably located at an upper portion of the casing, so that the leading lath of the shutter, in the closed position, would be at floor level and so the forcing of the shutter by insertion of a jemmy is rendered difficult or impossible by lack of space for leverage.

Thus, for the sidewalls of the casing to reflect the profiles of the conventional side panels of a bandit type gaming machine, each sidewall preferably has five perimeter edges, being parallel base and to edges which are orthogonal with respect to a back edge extending the full height of the gaming machine, with a front edge parallel to the back edge and extending upwardly from the base edge to approximately a mid height of the machine, where a fifth, inwardly tapering edge, extends to top edge to complete the five sided perimeter. In order to allow adequate ventilation to the gaming machine, and hence escape of heat from its electrical components, the back panel may be provided with a ventilation slit, or a series of louvre type slits. Furthermore, the base panel may be provided with suitable bolt holes or lugs so that it, and hence the casing, may be bolted to the floor.

The panels may be secured together to define the casing by bolts or by welding, or by a combination of bolts and welding.

The lower door is preferably rectangular and its releasability, to permit lower door removal for insertion and/or removal of a gaming machine, may be by means of a tongue on a lower edge of the lower door adapted to engage a slot or groove in the base panel or in a footplate supported on the base panel. In an arrangement with a footplate, the latter is removable (to permit insertion and removal of a gaming machine into and from the casing). Conveniently, a retaining abutment is welded to each side panel and/or to the base panel adjacent each sidewall, behind which retaining abutments the footplate is engageable. Releasable attachment to the side panels may conveniently be by bolts on an upper edge of the lower door, which bolts are displaceable manually by a centrally located, key operated, lock, with bolt ends (in the locking position) engaging selected ones of a series of holes, which may be provided about an arc, by the side panels or in the inside surfaces of the side panels.

Shutter displacement between extended and deployed positions may be effected manually or by power means, such as an electric motor. Likewise, locking of the shutter in its deployed position may be effected manually or by power means such as a solenoid. In detail, a steel pin may extend across each guide track a short distance from the terminal end of each guide track, beneath which pin may be engaged one end of an adjacent slide bar, the latter being housed within the terminal lath of the shutter and displaceable outwardly, from opposite ends of the terminal lath, to engage under a respective pin, by a key inserted into a lock at the centre of the terminal lath and rotated e.g. clockwise through 90°, to cause projection of ends of the slide bars, and rotatable anti-clockwise to cause retraction of the slide bars within the overall length of the terminal lath.

With power operation of displacement and/or locking, this may conveniently be done by having the casing—individually or a bank of casings—wired to a remote control console.

Although each casing preferably houses a single gaming machine, wider cabinets can be adapted to house two or more gaming machines.

Also, as industry standard gaming machines are 23" deep, they vary in width between 22" and 27", and hence a casing (to house any one machine) needs a front opening at least 27" wide. For the accommodation of machines of lesser width, each side panel may carry a spring-loaded side wall which not only constitute in-fill pieces, but also assist in squarely guiding a machine into its casing. Preferably, each sidewall is hinged, about a vertical axis, to its side panel adjacent the front edge thereof. It is also preferred for the terminal edge of each sidewall to be provided with one or more rollers e.g. of nylon, to engage, and roll along, the adjacent sidewall of the machine during insertion of a machine into the casing, or removal of a machine from the casing.

Hinging of each sidewall to its associated side panel may conveniently be via a mounting plate fixed e.g. by bolts, screws or rivets to sides of the guide tracks. The latter may be extrusions secured e.g. by bolts, screws or rivets, along the front edges of the side panels, and having mutually facing, square "C"-shaped slideways to receive the lath ends.

It is also preferred for each sidewall panel to be provided with at least one mirror to produce an enhanced lighting display utilising the reflection and refraction from the machines conventionally-provided lighting arrangements.

Additionally, a tie bar may extend across the front edges of the side panels to prevent those front edges being forced apart. Even if the side panels were forced apart—with a view to disengaging the ends of the shutter laths from their guide tracks—it is not possible to gain access to the machine, but such a tie bar avoids unnecessary damage, whilst also prevents the machine being pulled forwards whilst the casing is in its open condition.

Although the base panel, the back panel and the top panel may be formed integrally, by suitably bending or folding a sheet of steel of width 32" i.e. slightly exceeding the 27" machine width, preferably they are formed separately and secured together e.g. by bolts, as indicated previously. The side panels may be secured to the base, back and top panels by security bolts passing through aligned holes. By security bolts is meant a bolt having a plain, domed head at the outside of the casing, with a securing nut inside the casing. To prevent rotation of the bolt, a formation with flats e.g. a hexagon, may be located adjacent the head, to be received in a suitably sized aperture in a side panel.

If the shutter is of the roller type, it is preferably located on a mounting plate so that it may be removed and inserted, cartridge like, so as to present no obstruction during authorised machine insertion or removal from the casing, while the laths are preferably of double-walled, extruded aluminum e.g. of 40 mm depth.

The invention will now be described in greater detail by way of exam with reference to the accompanying drawings, in which:

FIG. 1 is a perspective view of a security casing in accordance with the invention with the roller shutter removed for clarity;

FIG. 2 corresponds to FIG. 1 but shows the roller shutter deployed;

FIG. 3 details the locking means of the casing;

Figure 7:
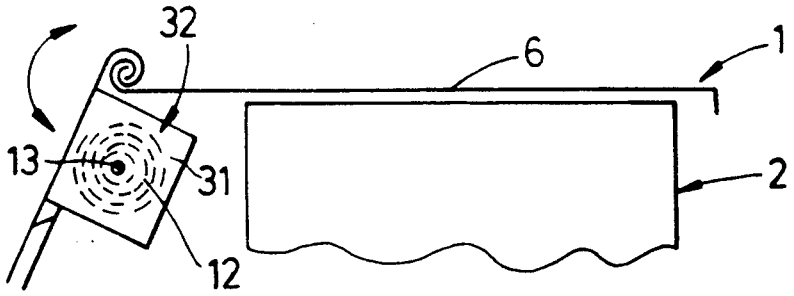
Figure 9:
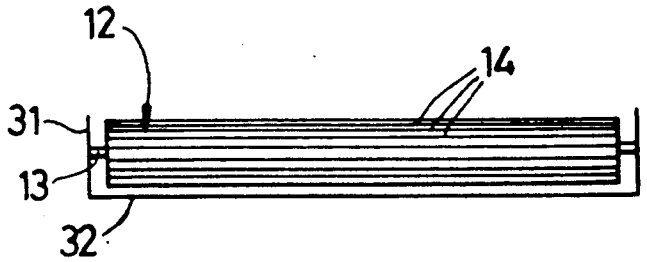

FIGS. 7 and 9 detail the roller shutter; and

Figure 10:
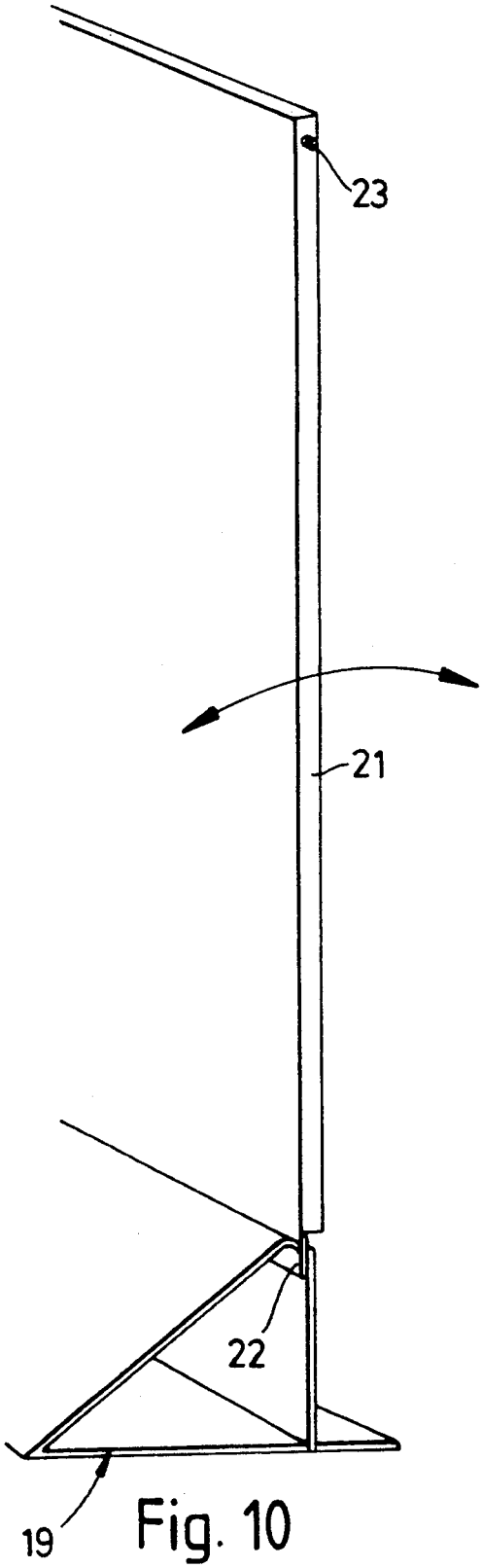
Figure 11:
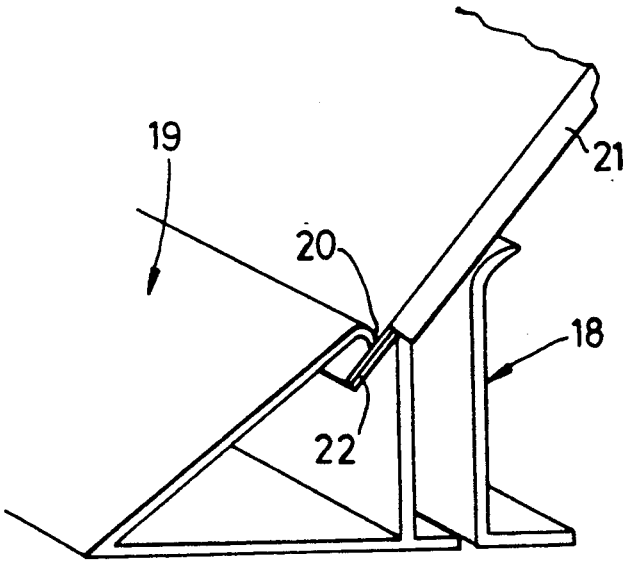

FIGS. 10 and 11 detail a lower door.

Figure 4:
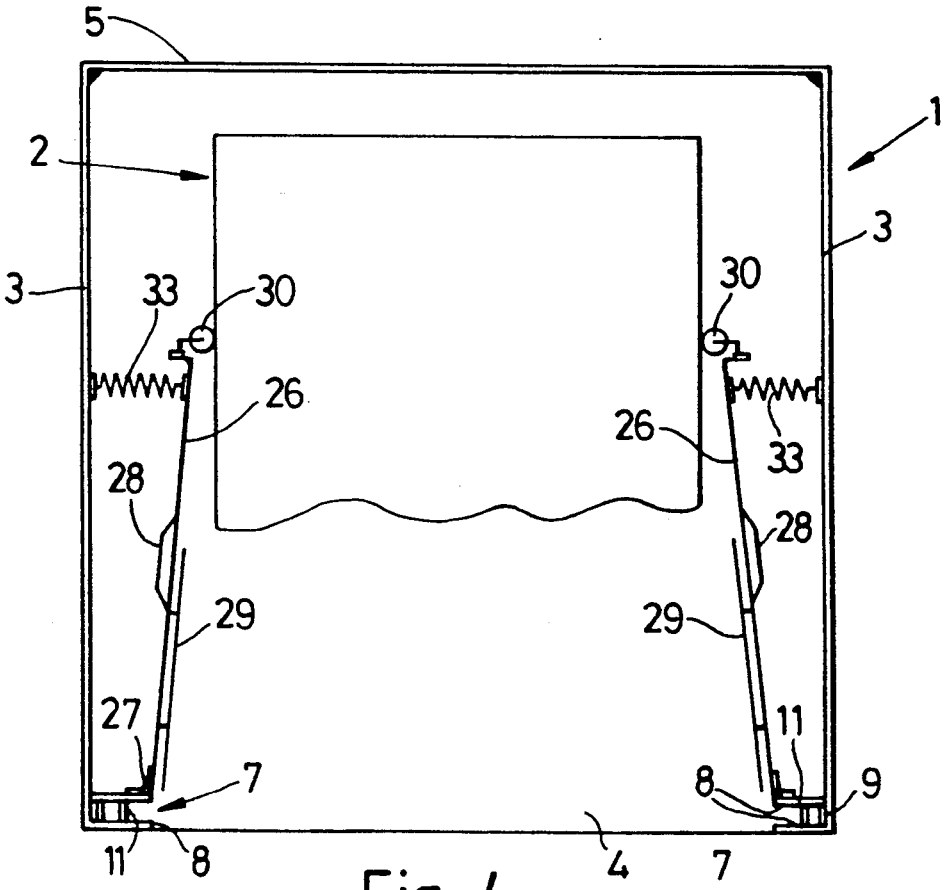
FIG. 4 is a plan view detailing the interior of the casing of FIGS. 1 and 2.

In the drawings is shown a security casing 1 for protecting a bandit type gaming machine 2 (FIG. 4) from cash theft. The casing 1 comprises a sheet steel carcase made up of two spaced-apart side panels 3, each reflecting the side profile of conventionally shaped side panels of an industry-standard gaming machine, a base panel 4, a back panel 5 and a top panel 6. The panels 3, 4 and 5 are all rectangular, approximating in dimensions to the base, back and top of the gaming machine 2, and the casing 1 is assembled by welding and/or bolting the panels together.

Figure 1:
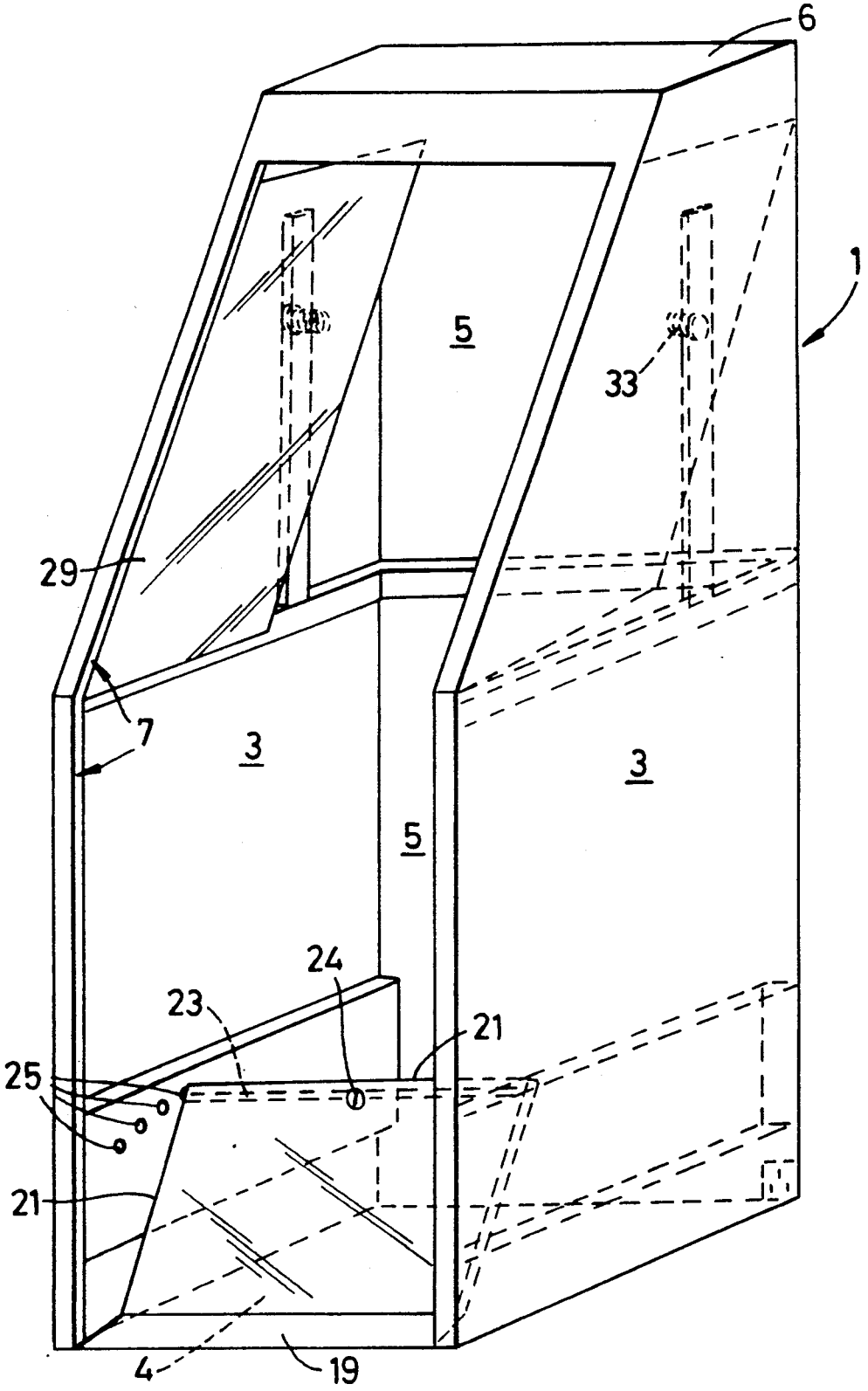
Figure 2:
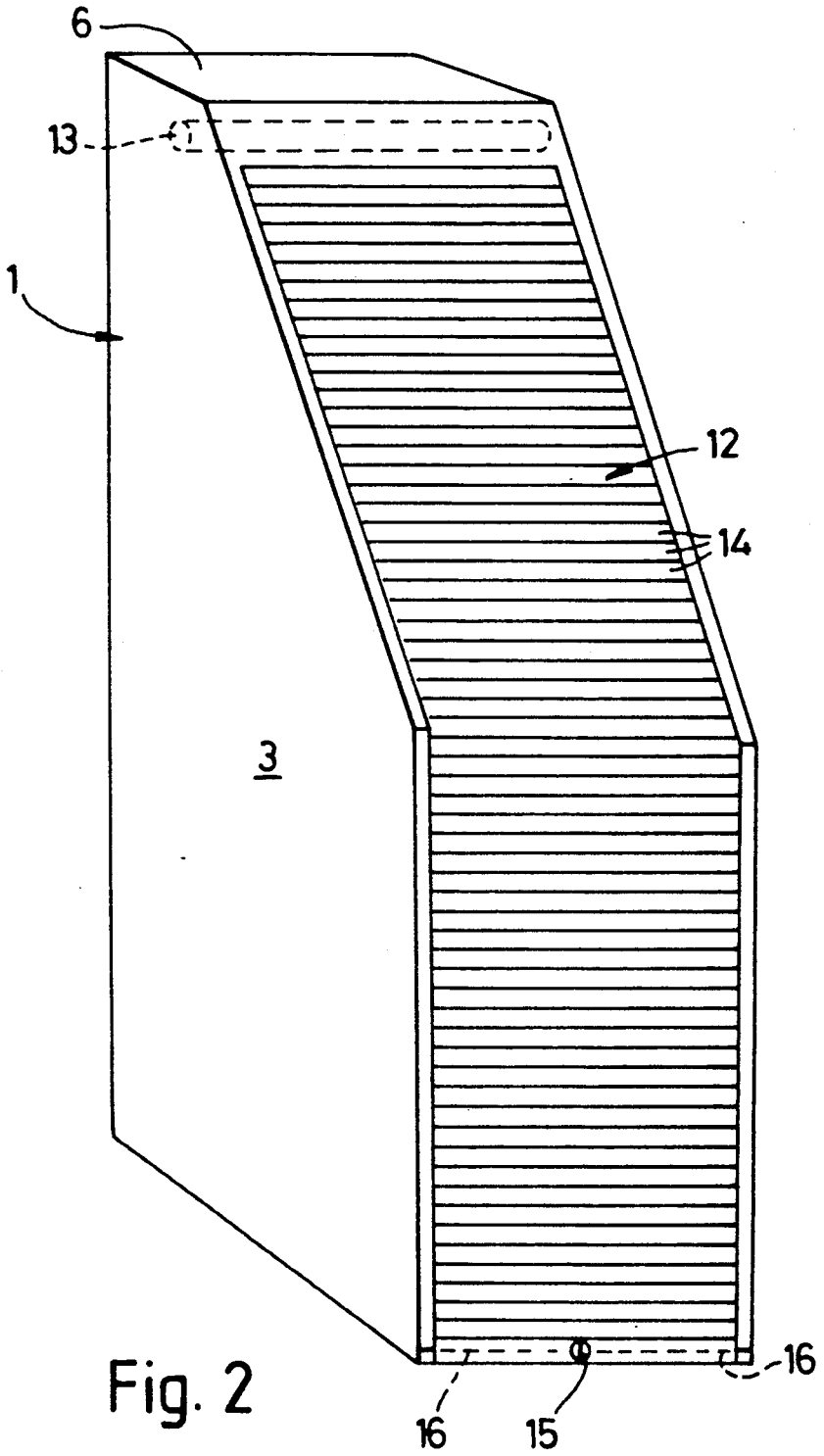
Figure 3:
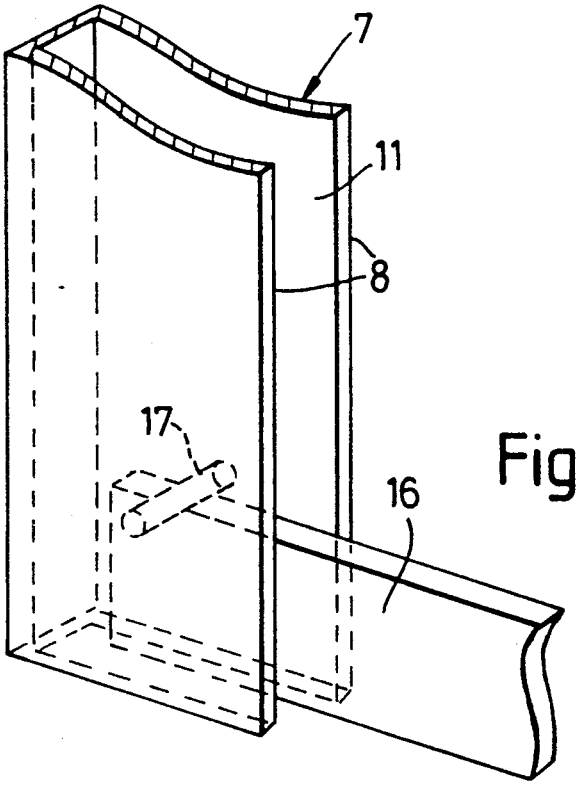
Figure 5:
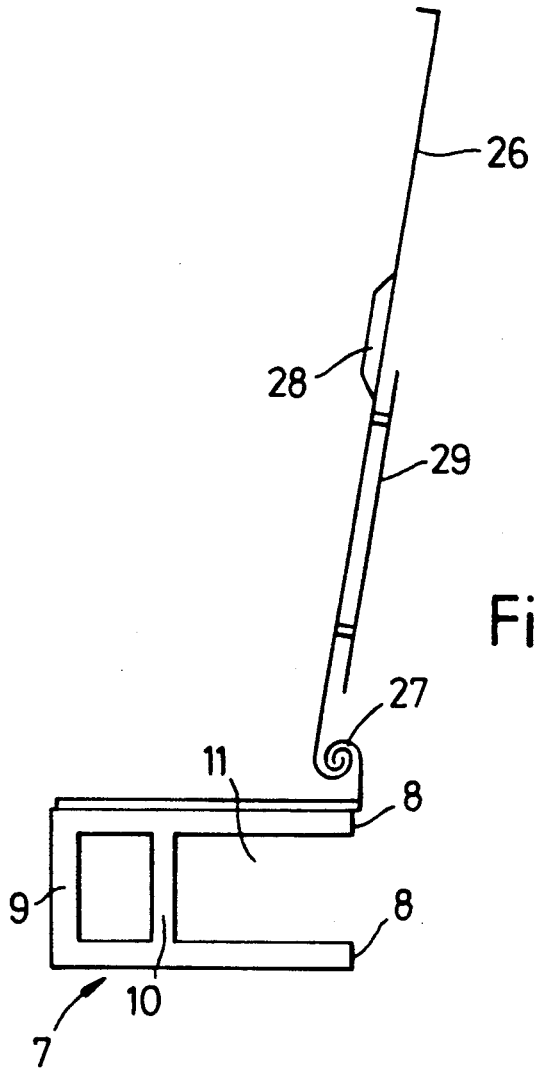
FIGS. 5 and 6 show, to an enlarged scale, further details of FIG. 2.
Figure 6:
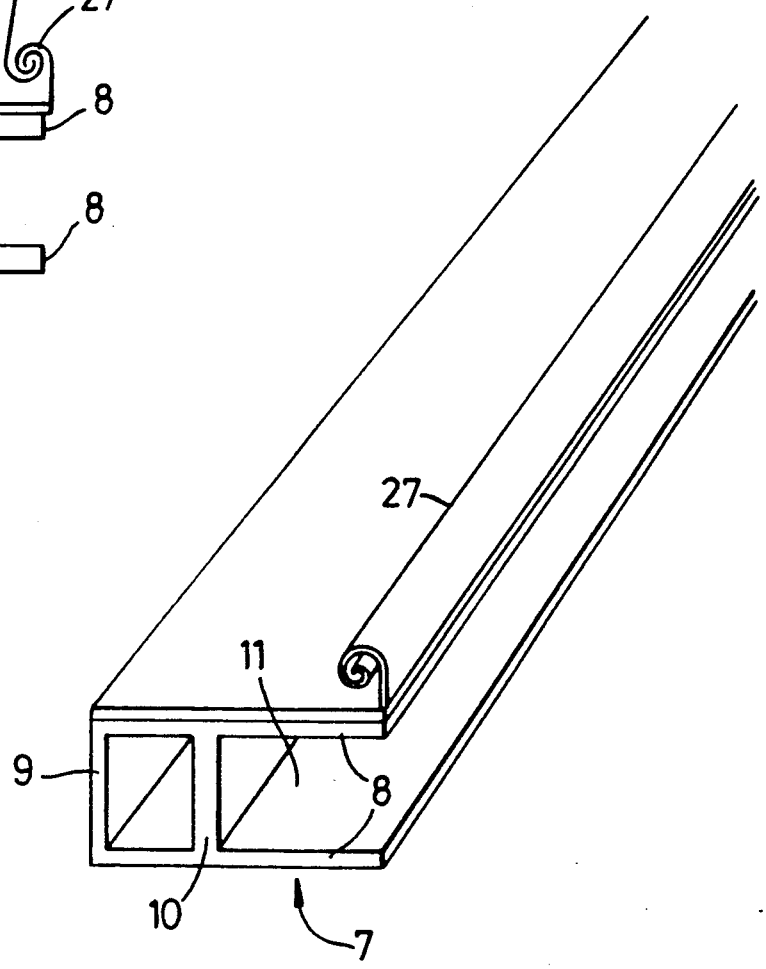

Each side panel 32 is provided with a guide track 7 best seen in FIGS. 1, 5 and 6, e.g. secured by bolts, and comprising a pair of spaced-apart, parallel rails 8 connected by a base 9 and an intermediate web 10 to define an open slot 11. A roller shutter 12, rotatable about a horizontal axis 13, is supported within the casing 1 adjacent the top thereof, and hence is displaceable vertically between its retracted and deployed positions, the latter being illustrated in FIG. 2. In detail, the shutter 12 comprises a plurality of laths 14, ends of which are slidable in the guide track slots 11. The shutter 12 may be operated manually, or by power means such as an electric motor, and in the deployed position, the shutter 12 is secured by a lock 15 operated locally, e.g. by a key (or remotely, e.g. by a solenoid controlled from a control panel) the lock 15 displacing laterally slideable bars 16 carried in the terminal lath of the roller shutter 12, so that ends of the bars 16 engage beneath a steel pin 17 extending across the rails 8 of each guide track 7 adjacent the lower edge of the side panels 3.

In detail, the casing 1 is provided at each front corner with a side stop 18 adjacent each side panel 2, against which side stops a foot plate 19 is engageable, the foot plate 19 having a groove 20, while a lower door 21 is provided with a tongue 22 to engage the groove 20, and is also provided with bolts 23 (FIG. 1), displaceable manually by a key-operated lock 24 to engage selected ones of a series of holes 25 provided around an arc in each side panel 2. As is apparent, the footplate 19 and lower door 21 must be removed to permit insertion into the casing 1 of the gaming machine 2, and after insertion, the footplate 19 and lower door 21 are replaced, to prevent unauthorised removal of the gaming machine 2 from the casing 1.

In order that a standard size of casing 1 can accommodate a plurality of industry-standard gaming machines of different widths, each side panel 3 is provided with a side wall 26 attached by a hinge 27 to an adjacent side panel 3, under the influence of a spring 33. Each spring loaded side wall 26 has a reinforcing strut 28 on its inner side and a mirror 29 on its outer side, while a nylon wheel 30 located at its innermost edge is adapted to roll along the side walls of the gaming machine 2 during insertion of the machine into the casing 1, or removal of the machine, from the casing 1. As best seen in FIGS. 5 and 6, the hinge 27 is secured e.g. by bolts or welding, to the guide tracks 7.

Figure 8:
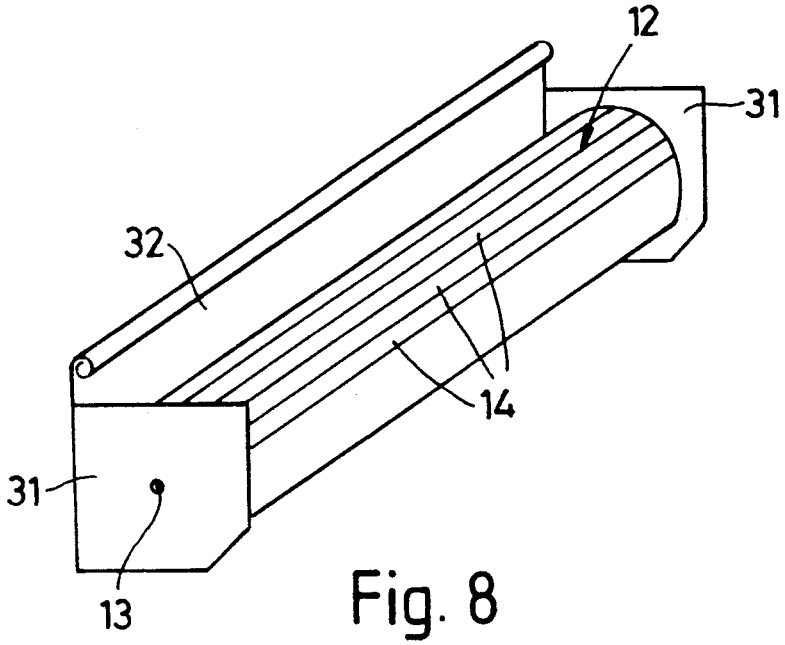

As indicated in FIG. 7 to 9, the roller shutter 12 is preferably provided as an insertable and removable cartridge by being rotatably supported from side walls 31 of a mounting plate 32.

What is claimed is:

1. A security casing for protecting a bandit type gaming machine from cash theft, said casing comprising (i) a sheet steel carcase made up of two side panels reflecting the profile of conventional side panels of a bandit type gaming machine, a base panel, a back panel and a top panel, said base back and top panels being rectangular and approximating in dimensions to the base, back, and top dimensions of an industry-standard bandit type gaming machine, so that said casing as a whole is a reasonably close fit about such gaming machine, said panels being secured together to define an open fronted casing;

(ii) a cash container-protecting lower door which is removable by an authorized person to allow insertion of a gaming machine having a cash container into said casing, or removal of a gaming machine from said casing, and, after insertion of said gaming machine, is positionally adjustably by said authorised person into close proximity with said cash container of said gaming machine remaining permanently locked in said protecting position until unlocked by an authorised person, said lower door extending upwardly from said base panel, and extending laterally with respect to said side panels to which it is also releasably attached;

(iii) a metal-latch shutter located within said casing, at a front zone of said casing, and being movable between a retracted position in which said casing is open-fronted to provide access to said gaming machine, and a deployed position, in which said casing and hence the gaming machine are closed-off, said shutter when deployed defining a front of said casing;

(iv) front edges provided on said side panels, guide tracks provided along said front edges, a plurality of laths defining said shutter with said ends of said shutter being displaceable along said guide tracks, and (v) means to lock said shutter in its deployed position.

2. A security casing as claimed in claim 1, wherein said shutter is movable vertically between retracted and deployed positions.

3. A security casing as claimed in claim 1, wherein said shutter is a roller shutter.

4. A security casing as claimed in claim 1, wherein said shutter is located at an upper portion of the casing.

5. A security casing as claimed in claim 1, wherein each said sidewall has five perimeter edges, being parallel base and top edges which are orthogonal with respect to a back edge extending the full height of said gaming machine, with a front edge parallel to said back edge and extending upwardly from said base edge to approximately a mid height of said machine, where a fifth, inwardly tapering edge, extends to said top edge to complete said five edged perimeter.

6. A security casing as claimed in claim 1, wherein said lower door is rectangular.

7. A security casing as claimed in claim 6, wherein a tongue is provided on a lower edge of said lower door, said tongue being receivable within a groove formed in a footplate disposed upon said base panel.

8. A security casing as claimed in claim 7, wherein said footplate is removable.

9. A security casing as claimed in claim 1, wherein an upper edge is provided on said lower door and bolts are provided on said upper edge, whereby said lower door is releasably attachable to said side panels.

10. A security casing as claimed in claim 9, wherein said bolts are displaceable manually by a centrally located, key operated lock, with ends of said bolts, in a locking position, engaging selected ones of an arc of holes of said side panels.

11. A security casing as claimed in claim 1 adapted to house a single industry-standard gaming machine.

12. A security casing as claimed in claim 1, wherein each said side panel carries a spring-loaded sidewall, which not only constitute in-fill piece, but also assist in squarely guiding a gaming machine into said casing.

13. A security casing as claimed in claim 12, wherein each said sidewall is hinged, about a vertical axis, to its side panel adjacent a front edge of said side panel.

14. A security casing as claimed in claim 12, wherein a terminal edge of each said sidewall is provided with at least one roller, to engage, and roll along, the adjacent sidewall of a gaming machine during insertion of a gaming machine into said casing, or removal of a gaming machine from said casing.

15. A security casing as claimed in claim 13, wherein hinging of each said sidewall to its associated side panel is via a mounting plate fixed to sides of guide tracks for said shutter.

16. A security casing as claimed in claim 1, wherein said guide tracks are extrusions secured along the front edges of the said side panels, and having mutually facing, square "C"-shaped slideways to receive the ends of laths of said shutter.

17. A security casing as claimed in claim 1, wherein each said side panel is provided with at least one mirror.

18. A security casing as claimed in claim 1, wherein said base panel, back panel and top panel are formed separately and secured together.

19. A security casing as claimed in claim 3, wherein said roller shutter is located on a mounting plate so as to be movable and insertable, cartridge like.

20. A security casing as claimed in claim 1, wherein locking of said shutter in its closed position is effected by a laterally extendable and retractable shoot bolt at each end of a leading lath of said shutter.

* * * * *